US006373172B1

(12) United States Patent
Kanao et al.

(10) Patent No.: US 6,373,172 B1
(45) Date of Patent: Apr. 16, 2002

(54) SPARK PLUG FOR INTERNAL COMBUSTION ENGINE HAVING A STRAIGHT PILLAR GROUND ELECTRODE

(75) Inventors: Keiji Kanao, Chita-gun; Tunenobu Hori, Kariya, both of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/468,803

(22) Filed: Dec. 21, 1999

(30) Foreign Application Priority Data

Dec. 21, 1998 (JP) ..... 10-363027
Nov. 15, 1999 (JP) ..... 11-324569

(51) Int. Cl.[7] ..... H01T 13/20
(52) U.S. Cl. ..... 313/141; 313/144

(58) Field of Search ..... 313/132, 135, 313/141, 144

(56) References Cited

FOREIGN PATENT DOCUMENTS

| | | |
|---|---|---|
| JP | 04-104491 | 4/1992 |
| JP | 08-298178 | 11/1996 |

*Primary Examiner*—Vip Patel
(74) *Attorney, Agent, or Firm*—Pillsbury Winthrop LLP

(57) ABSTRACT

In a spark plug having a straight pillar type ground electrode whose protruding length into the combustion chamber is relatively short, an intermediate member is provided at a bridging portion between the end of the housing and the leading end of the ground electrode so as to easily adjust the spark discharge gap.

19 Claims, 11 Drawing Sheets

FIG. 5
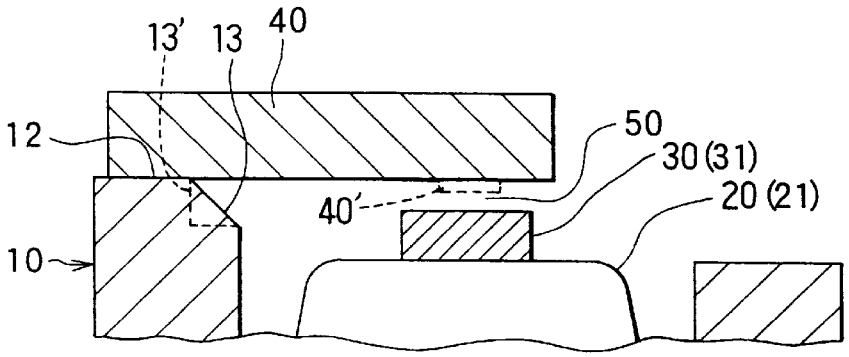
FIG. 6A
FIG. 6B
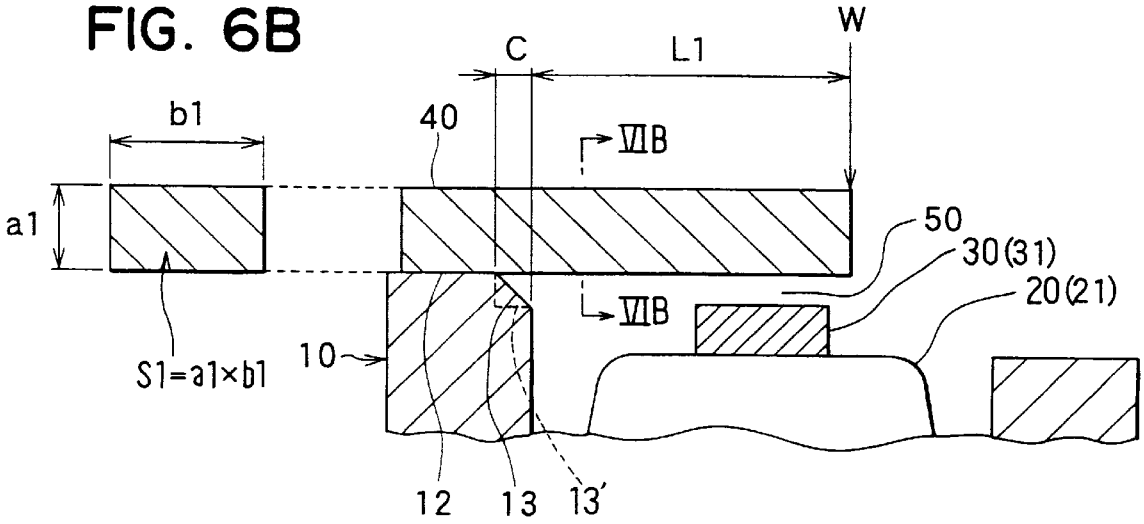

FIG. 9A
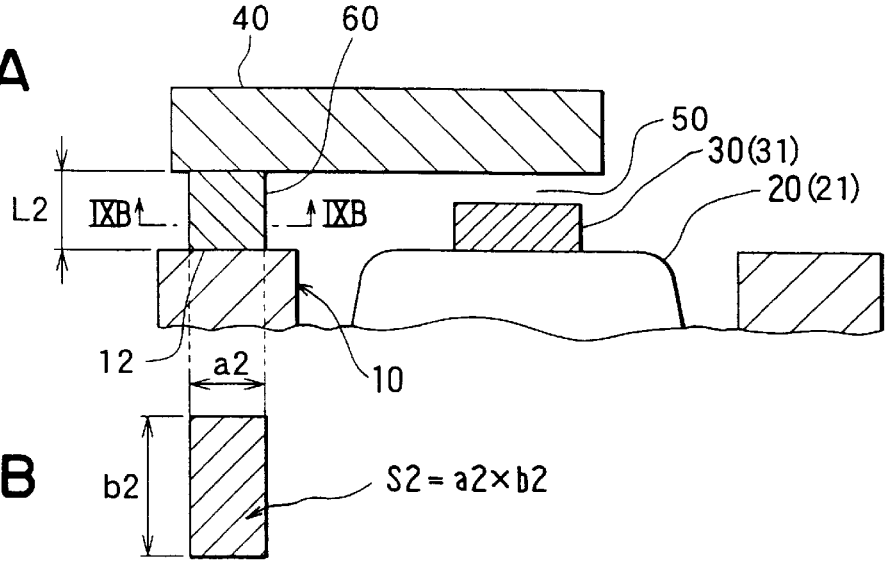
FIG. 9B
FIG. 10
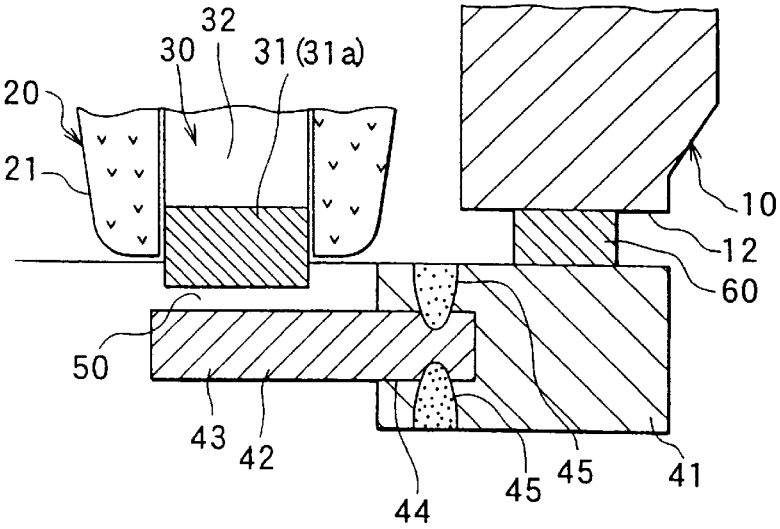

a4
b4
S4=a4×b4
W
L3
P
XIIIC
XIIIB
20(21)
30(31)
70
12
10
b3
a3
S3=a3×b3

SPARK PLUG FOR INTERNAL COMBUSTION ENGINE HAVING A STRAIGHT PILLAR GROUND ELECTRODE

CROSS REFERENCE TO RELATED APPLICATIONS

This application is based upon and claims the benefit of priority of Japanese Patent Applications No. H.10-363027 filed on Dec. 21,1998 and No. H-324569 filed on Nov. 15, 1999, the contents of which are incorporated herein by reference.

BACKGROUND OF THE INVENTION

1. Field of the Invention

The present invention relates to a spark plug for internal combustion engine provided with a straight pillar type ground electrode extending perpendicularly to a metal housing, in particular, applicable to the engine for a co-generation system, a delivery pump for pressurized gas and a vehicle.

2. Description of Related Art

A conventional spark plug, as shown in FIG. 16, has generally a center electrode J4 fitted through an insulator J3 into a housing J1 and a ground electrode J2 fixed to the housing J1. The center electrode J4 partly exposed out of the end of the insulator J3 faces the ground electrode J2. The ground electrode J2 is curved in a letter L shape to form a spark discharge gap between a leading end of the center electrode J4 and a leading end of the ground electrode J2.

In the engine for the co-generation system, for example, a higher heat resistance characteristic of the spark plug is required so that a thickness of the ground electrode J2 may be relatively thick and material of the ground electrode J2 is relatively hard. Therefore, a length h of the ground electrode J2 protruded into a combustion chamber of the engine tends to be longer because of difficulty of sharply bending into the letter L shape. As the protruded length h into the combustion chamber is longer, temperature of the ground electrode becomes higher and the heat resistance of the spark plug is more rapidly deteriorated.

Further, in the spark plug, for example, applicable to the engine for the co-generation system or the pressurized gas delivery pump, a periodical spark discharge gap adjustment is required because an electrode consumption by the spark discharge is more rapidly made.

SUMMARY OF THE INVENTION

The present invention has been made in view of the above mentioned problems or requirements, and an object of the present invention is to provide a spark plug having a straight pillar type ground electrode whose protruding length into the combustion chamber is relatively short so that the temperature of the ground electrode may be kept low and a longer life time of heat resistance may be assured. In addition, the spark plug is provided with an easy gap adjustment means.

To achieve the above object, the spark plug is composed of a center electrode, a housing holding and being insulated with the center electrode so as to expose a leading end of the center electrode out of an end thereof, a ground electrode bonded at a first leading end thereof to the end of the housing and extending straight from the housing substantially perpendicular to an axis of the housing so as to form a spark discharge gap between the leading end of the center electrode and a second leading end thereof, and means for easier adjustment of the spark discharge gap provided at least at any one of portions consisting of an inside edge of the end of the housing, a bridging portion between the end of the housing and the first leading end of the ground electrode, and an outside surface of the ground electrode. The means for easier adjustment of the spark discharge gap is operative in such a manner that the second leading end of the ground electrode comes near the leading end of the center electrode with less force for adjusting the spark discharge gap.

As an aspect of the present invention for realizing a longer life time and a better performance of the spark plug, a noble metal chip or element such as Ir alloy or Pt alloy may be bonded to the second leading end of the ground electrode.

As one of the means for easier adjustment of the spark discharge gap, a relief such as a chamfering or a step is provided at least at an inside edge of the leading end of the housing to which the first leading end of the ground electrode is fixed in order to secure a longer distance to a fulcrum for bending the ground electrode. Therefore, as a length C of the chamfering or the step in the longitudinal direction of the ground electrode is longer, the spark discharge gap adjustment becomes easier.

However, the length C of the chamfering or the step is preferably not longer than 2.0 mm because the length longer than 2.0 mm causes to limit an area where the ground electrode and the housing are bonded and fixed to each other to an extent that bonding strength reliability may not be assured.

As another one of the means for easier adjustment of the spark discharge gap, an intermediate member may be arranged between the leading end of the housing and the first leading end of the ground electrode. The intermediate member is formed in a shape that a cross sectional area S2 of the intermediate member in parallel with the longitudinal direction of the ground electrode is narrower than a cross sectional area (thickness length multiplied by width length) of the ground electrode or is made of material having a lower tensile strength than that of the ground electrode. As a result, the intermediate member may be more easily deformed perpendicular to a longitudinal direction of the ground electrode or to change an angle with the ground electrode.

Further, it is preferable that the cross sectional area S2 is not smaller than 3.0 $mm^2$ and not larger than 8.0 $mm^2$. When the cross sectional area S2 is smaller than 3.0 $mm^2$, heat transfer through the intermediate member gets worse so that temperature of the ground electrode may be unusually increased. On the other hand, When the cross sectional area S2 is larger than 8.0 $mm^2$, an area where the intermediate member is bonded to the housing is too large to secure an adequate bonding strength.

Furthermore, a thickness L2 of the intermediate member is preferably not shorter than 0.5 mm and not longer than 3.0 mm. When the thickness L2 is shorter than 0.5 mm, the intermediate member itself is too short to be deformed by an aimed amount. When the thickness L2 is larger than 3.0 mm, the ground electrode is protruded too deeply into the combustion chamber so that the heat resistance characteristic may be rapidly deteriorated.

In addition, it is preferable that the cross section of the intermediate member is shaped as a rectangular with a short side in parallel with the longitudinal direction of the ground electrode and a long side perpendicular to the longitudinal direction of the ground electrode to have the ground electrode more easily bend. For easily and reliably bonding the intermediate member to the housing, it is also preferable that a length a2 of the short side is not larger than 2.0 mm and a length b2 of the long side is not larger than 4.0 mm.

Material of the intermediate member is preferably a Ni or Fe base alloy having a tensile strength of 350 to 1300 $N/mm^2$.

As further one of the means for easier adjustment of the spark discharge gap, an outside surface or surfaces of the ground electrode are provided with a groove or grooves passing perpendicularly through the ground electrode. Though the groove may be provided in parallel with an adjustment direction of the spark discharge gap so as to narrow the width of the ground electrode at the grooved portion, it is more preferable that the groove is provided perpendicular to the adjustment direction of the spark discharge gap so as to make the thickness of the ground electrode thinner at the grooved portion.

A cross sectional area S3 of the ground electrode at the grooved portion is preferably not smaller than 2.0 $mm^2$. When the cross sectional area S3 is smaller than 2.0 $mm^2$, heat transfer through the ground electrode at the grooved portion gets worse so that temperature of the ground electrode may be unusually increased.

On the other hand, it is preferable that a length P of the groove is not shorter than 0.5 mm and not longer than 2.0 mm. When the length P is shorter than 0.5 mm, an adequate bending of the ground electrode becomes difficult. When the length P is longer than 2.0 mm, an unfavorable restriction of heat transfer through the grooved portion becomes too large. Further, it is preferable that the groove is away by more than 3.0 mm from the second leading end of the ground electrode. Furthermore, material of the ground electrode is preferably a Ni base alloy having a tensile strength of 350 to 1400 $N/mm^2$.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

FIG. 5 is a cross sectional view of the spark plug according to a second embodiment;

FIG. 6A is a schematic view for explaining means for easier adjustment of the spark discharge gap;

FIG. 6B is a cross sectional view taken along a line VIB—VIB of FIG. 6A;

FIG. 9A is a cross sectional view of a spark plug according to a third embodiment;

FIG. 9B is a cross sectional view taken along a line IXB—IXB of FIG. 9A;

FIG. 10 is a cross sectional view of a spark plug according to a fourth embodiment;

DETAILED DESCRIPTION OF THE PREFERRED EMBODIMENTS

Figure 1:
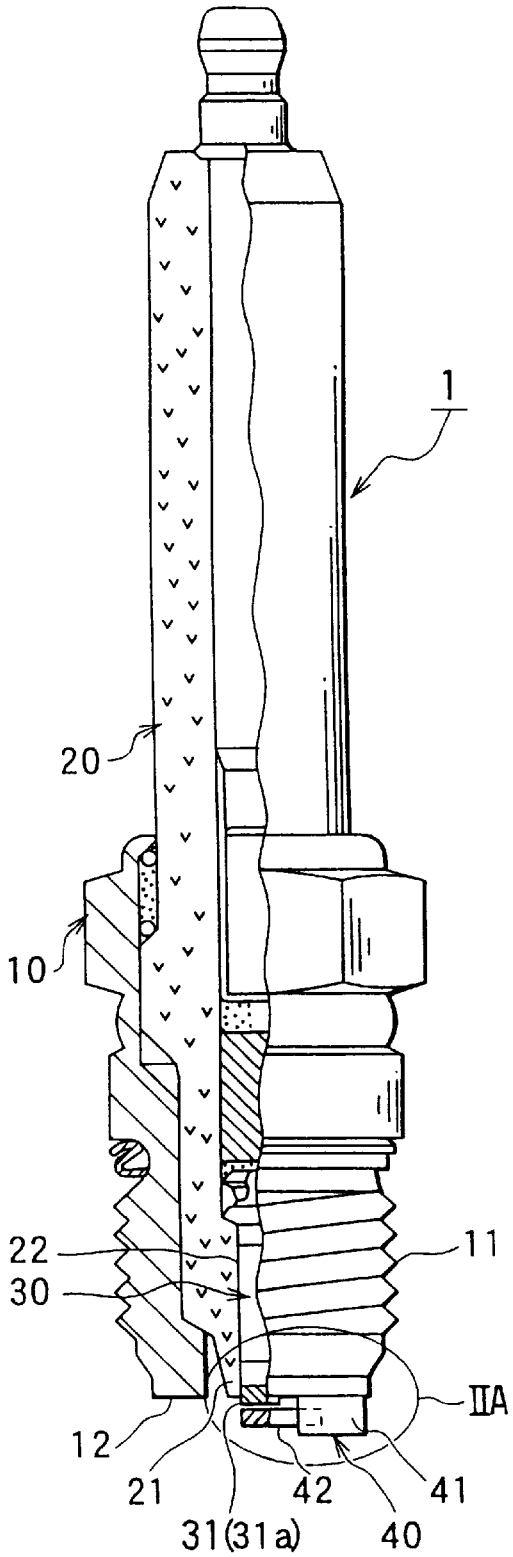
FIG. 1 is a semi cross sectional view of a spark plug according to the present invention.
Figure 2A:
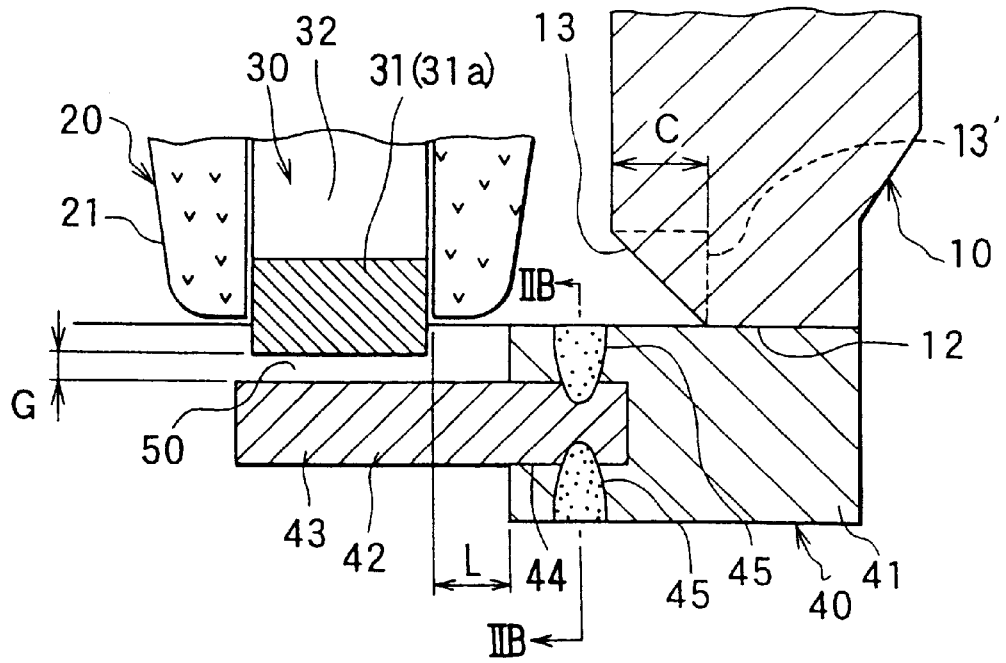
FIG. 2A is a partly enlarged cross sectional view of an encircled IIA of FIG. 1 according to a first embodiment.
Figure 2B:
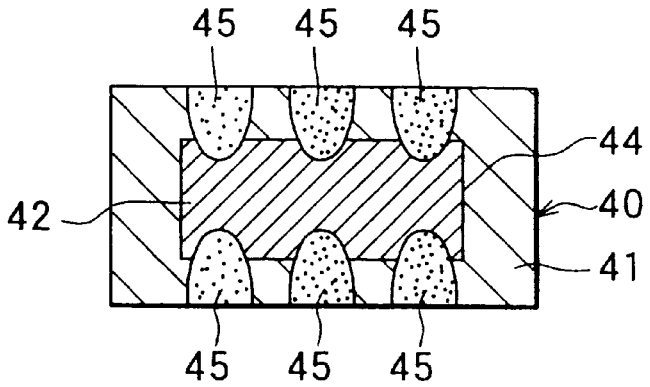
FIG. 2B is a cross sectional view taken along a line IIB—IIB of FIG. 2A.

FIG. 1 shows a semi-cross sectional view of a spark plug for an internal combustion engine according to the present invention. FIG. 2A is a partly enlarged cross sectional view of an encircled portion IIA of FIG. 1 and FIG. 2B is a cross sectional view taken along a line IIB—IIB of FIG. 2A. The spark plug 1 according to the present embodiment is preferably applicable to gas engines for generators in a co-generation system.

The spark plug 1 has a tubular housing 10 having a thread 11 for mounting to an engine cylinder block (not shown). An insulator 20 made of alumina ceramics ($Al_2O_3$) is fitted into the housing 10 and an end portion 21 of the insulator 20 is exposed out of an end 12 of the housing 10. A center electrode 30 is inserted and fixed at a through hole 22 of the insulator 20 so as to be held by and insulated with the housing 10 through the insulator 20. A leading end portion 31 of the center electrode 30 is exposed out of the end portion 21 of the insulator 20. The center electrode 30 is composed of a column shaped main body 32 and a disk shaped Ir alloy chip 31*a* bonded by welding to the main body to constitute the leading end portion 31 mentioned above. An inner member of the main body 32 is made of metal material having good thermal conductivity such as copper and an outer member is made of metal material having good heat resistance and corrosion endurance such as Ni base alloy.

A ground electrode 40 is composed of a base element 41 made of Ni base alloy and a pillar shaped Ir alloy element 42 fixed by welding to the base element 41. The ground electrode 40 is formed nearly in a straight pillar shape as a whole. The base element 41 is fixed to the end 12 of the housing 10 on a horizontal side of the leading end portion 31 of the center electrode 30. A leading end portion 43 of the Ir alloy element 42 extending from the base element 41 faces the leading end portion 31 of the center electrode 30 to constitute a spark discharge gap 50 therebetween.

The base element 41 is formed in a rectangular block shape and the Ir alloy element 42 is formed in a rectangular shape. A surface of the end 12 of the housing 10 to which the base element 41 is fixed is in parallel with a direction to which the Ir alloy element 42 extends from the base element 41. The surface of the end 12 is provided with a taper shaped chamfering at an edge thereof on a side of the center electrode 30, that is, at an inside surface edge of the end 12 of the housing 10. Another leading end opposite to the leading end 43 of the Ir alloy element 42 is inserted into a bore 44 provided in the base element 41 and fixed to the base element 41 by laser welding. At portions where the base element 41 and the Ir alloy element 42 are bonded, there are provided with molten portions 45 where material of the elements are molten and mixed with each other extending from an outside surface of the base element 41 to an inside of the Ir alloy element 42 to secure a sufficient bonding strength.

The Ir alloy chip 31*a* is made of Ir alloy including more than 50 weight percent Ir similar to that of the Ir alloy element 42 for securing a better consumption resistance. The portions where the main body 32 and the Ir alloy chip 31*a* are welded are covered by the insulator 20 as shown in FIG. 2A.

The Ni base alloy applied to the outer member of the main body 32 of the center electrode 30 and the base element 41 of the ground electrode 40 may be, for example, INCONEL (trade mark).

The Ir alloy element 42 may be made of the Ir alloy containing more than 50 Wt % of Ir with at least one of materials such as rhodium (Rh), platinum (Pt), ruthenium (Ru), palladium (Pd) and tungsten (W) and, for example, Ir-10 Rh alloy (90 Wt % Ir and 10 Wt % Rh) may be used in this embodiment.

As mentioned above, the spark plug 1 according to the present embodiment is provided with a chamfering 13 at an inside corner of the end portion 12 of the housing 10, that is, at a leading edge of the housing 10 on a side of the center electrode 30. The chamfering 13 may be replaced by a step 13', as shown in dotted lines in FIG. 2A. Further, the chamfering 13 or step 13' may be provided all around the inner circumference of the housing 10 or partly only on a portion where the base element 41 is fixed to the housing 10.

In a case of the spark plug applied to the engine for the co-generation system or the pressurized gas delivery pump, it is common that the spark discharge gap is periodically adjusted because an electrode consumption by the spark discharge is rapidly made. Therefore, when a length of the Ir alloy element 42 is relatively long and a length of the base element 41 is relatively short as is so in the spark plug according to the present embodiment, it becomes effective to have some means for more easily deforming the base element 41 to adjust the spark discharge gap 50. A relief such as the chamfering 13 or the step 13' serves to more easily adjust the spark discharge gap 50. A length C of the chamfering 13 or the step 13' in a longitudinal direction of the base element 41 is 1.0 mm in the present embodiment.

Figure 3:
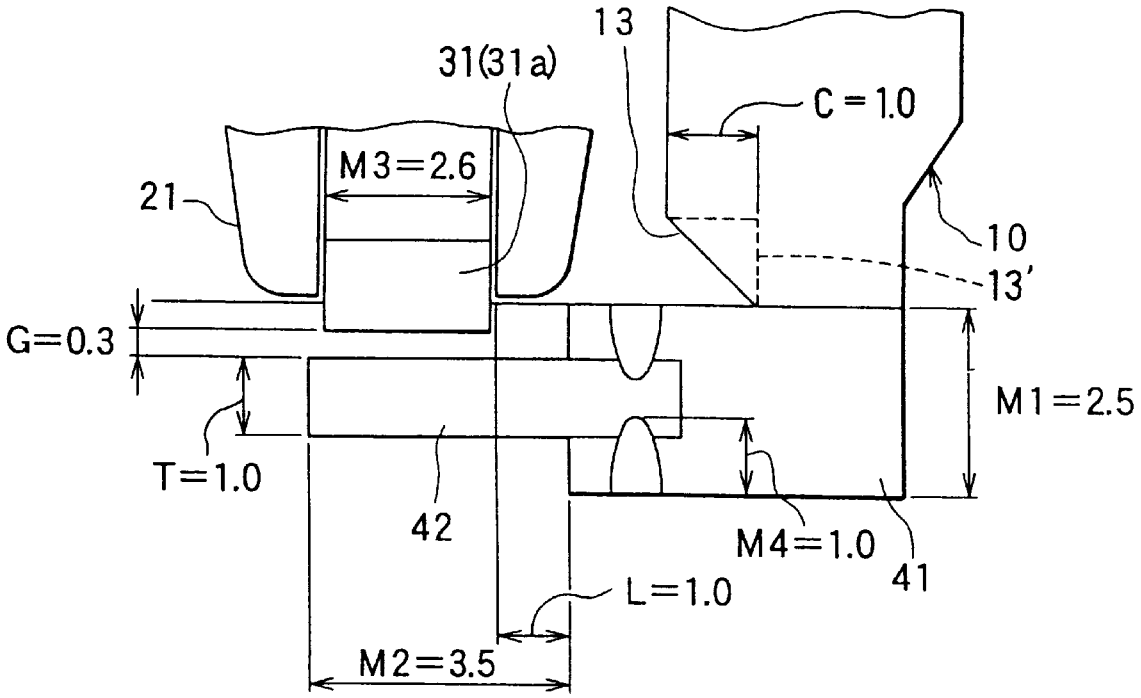
FIG. 3 is a drawing showing dimensions of the spark plug according to the first embodiment.

FIG. 3 shows respective dimensions of the spark plug 1 according to the present invention. FIG. 3 is a drawing corresponding to FIG. 2A without hatching. The unit of the dimension shown in FIG. 11 is millimeter (mm).

A distance G of the spark discharge gap is 0.3 mm, a distance L between the leading end portion 31 of the center electrode 30 and the base element 41 of the ground electrode 40 is 1.0 mm, a thickness Ml of the base element 41 is 2.5 mm, a thickness T of the Ir alloy element 42 is 1.0 mm, a length M2 of the Ir alloy element 42 extruded out of the base element 41 is 3.5 mm, a diameter M3 of the disk shaped Ir alloy chip 31*a* is 2.6 mm, a length M4 of the molten portion 45 is 1.0 mm and the length C of the chamfering 13 or the step 13' is 1.0 mm.

Figure 4A:
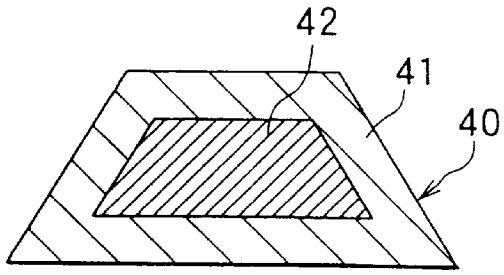
FIG. 4A is a cross sectional view showing a modification of the spark plug according to the first embodiment.
Figure 4B:
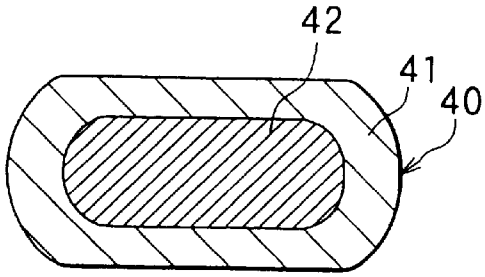
FIG. 4B is a cross sectional view showing another modification of the spark plug according to the first embodiment.

The cross section of the Ir alloy element 42 is not limited to the rectangular shape as mentioned above and may be any shape, if it is of a pillar type, for example, a trapezoidal or elliptical shape as shown in FIG. 4A or 4B.

Figure 4C:
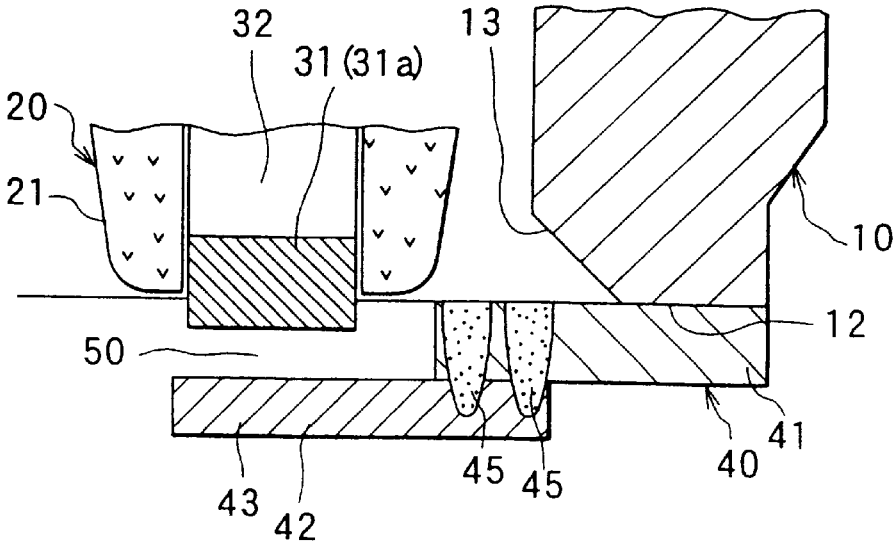
FIG. 4C is a cross sectional view showing a further modification of the spark plug according to the first embodiment.

Further, as shown in FIG. 4C, the ground electrode 40 may have such a construction that the Ir alloy element 42 is bonded to a surface of the leading end of the base element 41 on an opposite side to the fixed portion thereof.

Furthermore, In place of the Ir alloy, any noble metal such as Pt alloy is applicable to the embodiment mentioned above and, to bond the noble metal including the Ir alloy element 42 to the base element 41, plasma welding may be applied instead of the laser welding as mentioned above.

Next, means for easily adjusting the spark discharge gap is described in more detail. The spark discharge adjustment may be required not only for the spark plug as mentioned above with reference to FIG. 2A but also for a type of a spark plug as shown in FIG. 5. FIG. 5 shows a spark plug according to a second embodiment and a modification of the spark plug shown in FIGS. 2A and 2B, in which all of the ground electrode is made of the Ni or Fe base alloy and extends straight from and perpendicular to the housing. A noble metal chip made of, for example, Pt alloy or Ir alloy as shown in a dotted line of FIG. 5 may be bonded to a leading end of the ground electrode to constitute a spark discharge spot. Similar parts and components as shown in FIGS. 2A and 2B have the same reference numbers.

As shown in FIG. 5, a chamfering 13 or a relief 13' is formed by machining at least at the end of the housing to which the ground electrode 40 is fixed. When the ground electrode 40 is pressed at the leading end on an opposite side to the housing, a longer distance to a fulcrum for bending the ground electrode 40 can be secured so that the spark discharge gap may be adjusted with a less force.

As the length C is longer, the ground electrode 40 may be more easily bent. It is preferable, however, that the length C is not longer than 2.0 mm since more than 2.0 mm length of the relief makes too narrow an area where the ground electrode 40 and the housing 10 are bonded so that a reliable bonding strength may not be assured.

FIGS. 6A and 6B show a schematic view applicable to both the spark plug as shown in FIG. 5 and the spark plug as shown in FIGS. 2A and 2B for explaining means for easier adjustment of the spark discharge gap. The ground electrode 40 has a rectangular cross section perpendicular to a longitudinal direction thereof with a short side and a long side, as shown in FIG. 6B, and is fixed to the end 12 of the housing 10 at a side surface thereof including the long side. A length a1 of the short side of the rectangular cross section is a thickness of the ground electrode 40 and a length b1 of the long side thereof is a width of the ground electrode 40. An area S (a1×b1) of the rectangular cross section is preferably not smaller than 3.0 $mm^2$ and not larger than 8.0 $mm^2$. When the area S1 is smaller than 3.0 $mm^2$, a heat transfer through the ground electrode 40 gets worse so that the heat resistance characteristic may be deteriorated. On the other hand, when the area S1 is larger than 8.0 $mm^2$, an area where the ground electrode 40 is bonded to the housing 10 becomes too large to secure an adequate bonding strength.

Further, when the width b1 of the ground electrode 40 is too narrow or too wide, a boding reliability of the ground electrode 40 to the housing 10 becomes insufficient. Therefore, the width b1 of the ground electrode 40 is preferably not shorter than 1.2 mm and not longer than 4.0 mm. A length L1 extending from the end 12 of the housing 10 is preferably not longer than 6.0 mm from a practical standpoint. With respect ton a pressure force W (gap adjusting force) which is required for deforming the ground electrode 40 to shorten a distance of the spark discharge gap 50 by 0.3 mm, the force W of not weaker than 200 N is preferable as a minimum force for preventing the ground electrode 40 from being deformed by vibrations or combustion pressure during the engine operation and the force W of not stronger than 800 N is preferable for being able to deform easily the ground electrode 40 for example with a hammer.

Figure 7:
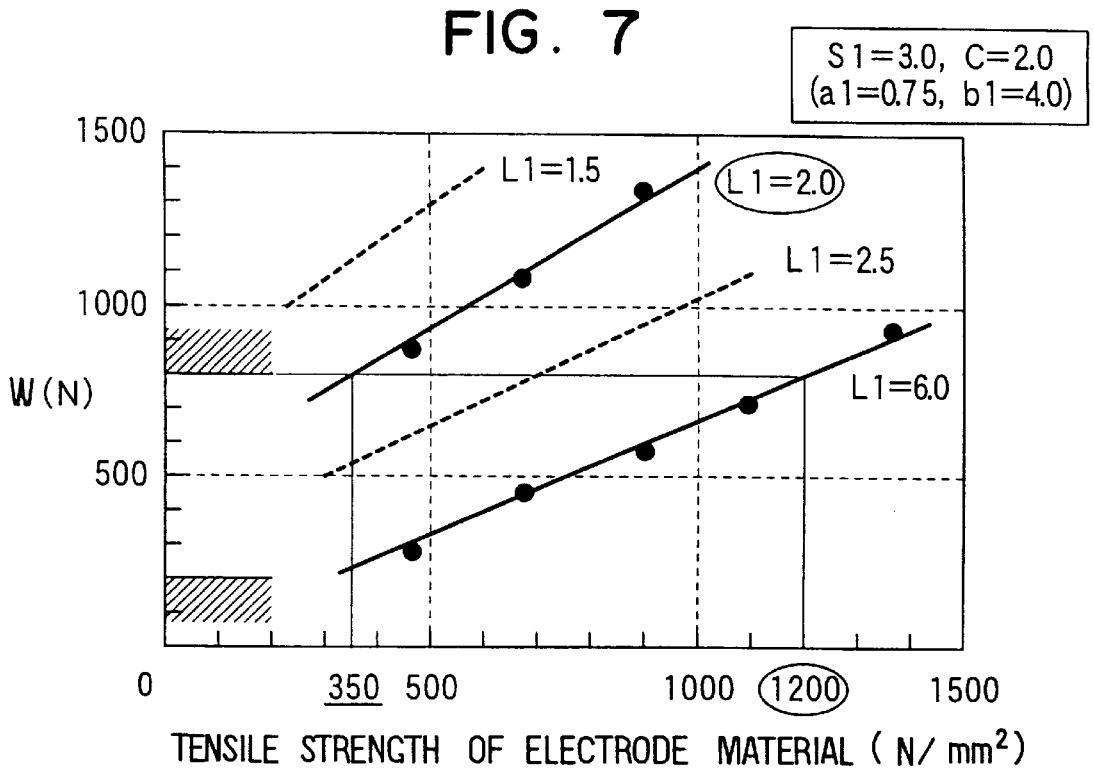
FIG. 7 is a graph showing a relationship between a tensile strength of electrode material and a gap adjusting force W with respect to a length L1 of a ground electrode extended from a housing.

FIG. 7 shows a relationship between the gap adjustment force (N) and a tensile strength ($N/mm^2$) of material of the ground electrode 40 with respect to the various lengths L1 of the ground electrode 40 extending from the end 12 of the housing 10. FIG. 7 shows a test result of the spark plug having dimensions that the ground electrode 40 is most easily deformed for the spark discharge gap adjustment, that is, when the cross sectional area S1 of the ground electrode 40 is 3.0 $mm^2$ (the thickness a1 of the ground electrode is 0.75 mm and the width b1 of the ground electrode is 4.0 mm),a lower limit of the preferable range, and the length C of the chamfering is 2.0 mm, an upper limit of the preferable range.

As shown in FIG. 7, as the length L1 is shorter or the tensile strength of electrode material is larger, the force W is larger, that is, the ground electrode 40 is more unlikely to be deformed to adjust the spark discharge gap. The test result shows that the length L1 of the ground electrode 40 is preferably not shorter than 2.0 mm in order for the ground electrode 40 to be able to be bent by less than 800N gap adjustment force W, as the minimum tensile strength of Ni base alloy is 350 $N/mm^2$.

If the length L1 becomes longer than 2.0 mm, the ground electrode made of Ni or Fe base alloy having larger tensile strength can be bent. However, when the length L1 is 6.0 mm, an upper limit of the preferable range, the maximum tensile strength is preferably not larger than 1200 $N/mm^2$ so as to bent the ground electrode with the less than 800 N gap adjustment force W.

Figure 8:
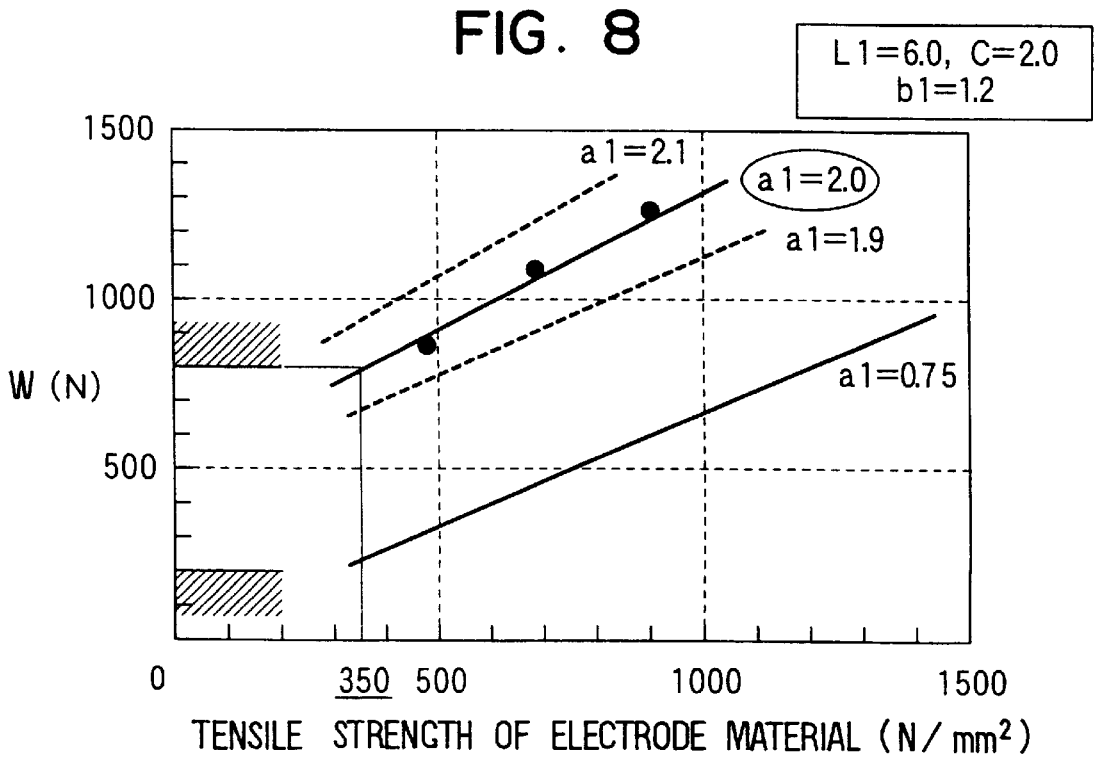
FIG. 8 is a graph showing a relationship between a tensile strength of electrode material and a gap adjusting force W with respect to a thickness a2 of the ground electrode.

FIG. 8 shows a relationship between the gap adjustment force (N) and a tensile strength ($N/mm^2$) of material of the ground electrode 40 with respect to the various thickness al of the ground electrode 40. FIG. 8 shows a test result of the spark plug having dimensions that the ground electrode 40 is most easily deformed for the spark discharge gap adjustment, that is, when the length L1 is 6.0 mm, the upper limit, the length C of the chamfering is 2.0 mm, the upper limit, and the width b1 of the ground electrode is 4.0 mm, a lower limit of the preferable range.

As shown in FIG. 8, as the thickness a1 is thicker or the tensile strength of electrode material is larger, the ground electrode 40 is more unlikely to be deformed to adjust the spark discharge gap. The test result shows that the thickness a1 of the ground electrode 40 is preferably not shorter than 2.0 mm so as to bend the ground electrode 40 with the less than 800N gap adjustment force W, as the minimum tensile strength of Ni base alloy is 350 $N/mm^2$.

To summarize the test results as shown in FIGS. 7 and 8, it is preferable to easily adjust the spark discharge gap that, when the ground electrode 40 is composed of a Ni or Fe base alloy, has a rectangular cross section perpendicular to a longitudinal direction thereof and is fixed to the end 12 of the housing 10 at a side surface thereof including one side of the rectangular cross section, the tensile strength of the Ni or Fe base alloy is 350 to 1200 $N/mm^2$, the area S1 of the rectangular cross section is not smaller than 3.0 $mm^2$ and not larger than 8.0 $mm^2$, the thickness a1 of the ground electrode is not longer than 2.0 mm, the width b1 of the ground electrode is not shorter than 1.2 mm and not longer than 4.0 mm and the length L1 is not shorter than 2.0 mm and not longer than 6.0 mm.

To easily adjust the spark discharge gap 50, in place of the chamfering or the step mentioned above, it is possible, as shown in FIGS. 9A, 9B and 10, to provide a rectangular shaped intermediate member 60 made of Ni base alloy (INCONEL) or Fe base alloy between the ground electrode 40 (the base element 41 in case of FIG. 10) and the housing 10. FIGS. 9A and 9B show a spark plug according to a third embodiment of the present invention which is a modification of the spark plug shown in FIG. 5. FIG. 10 shows a spark plug according to a fourth embodiment of the present invention which is a modification of the spark plug shown in FIGS. 2A and 2B.

Figure 11A:
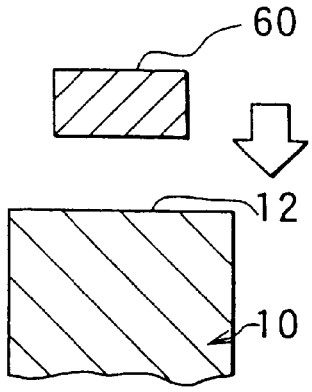
FIG. 11A is a cross sectional view of parts of the spark plug shown in FIG. 10 in a first manufacturing process.
Figure 11B:
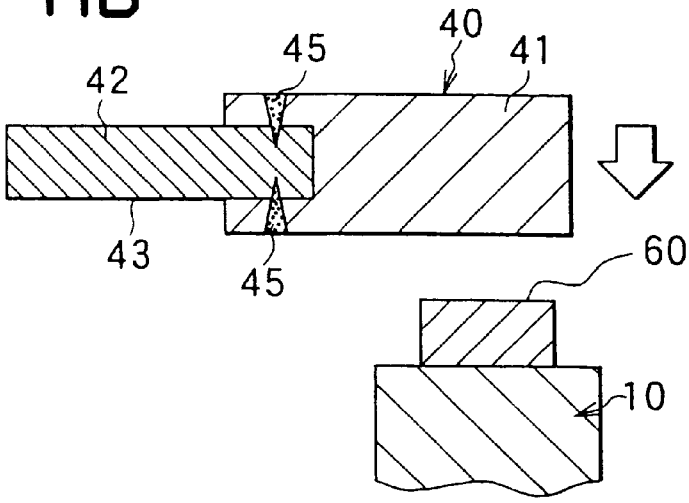
FIG. 11B is a cross sectional view of parts of the spark plug shown in FIG. 10 in a second manufacturing process.
Figure 11C:
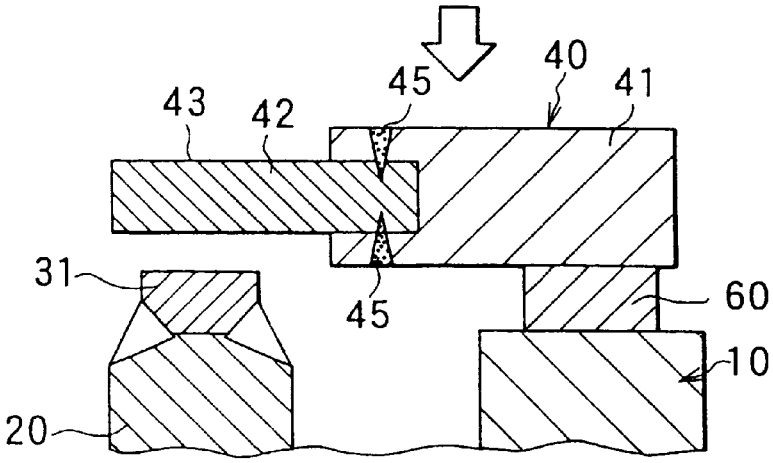
FIG. 11C is a cross sectional view of parts of the spark plug shown in FIG. 10 in a third manufacturing process.

As manufacturing processes of the spark plug having the intermediate member 60 as shown in FIG. 10, at first, an end of the intermediate member 60 is welded to the end portion 12 of the housing 10 as shown in FIG. 11A. Next, the base element 41 of the ground electrode 40 is welded to the other end of the intermediate member 60 as shown in FIG. 11B. Then, the spark plug is completed after the assembly process and the spark gap adjusting process as shown in FIG. 11C.

The manufacturing processes of the spark plug shown in FIGS. 9A and 9B is similar to the processes described in FIGS. 11 A to C except the base element 41 is replaced by the ground electrode 40. Though the below explanation is made with reference to FIGS. 9A and 9B, the explanation is also applicable to the spark plug shown in FIG. 10 by replacing the ground electrode 40 with the base element 41 or the Ir alloy element, as the case may be.

When a width length a2 (short side length) of a cross section of the intermediate member 60 in parallel with the longitudinal direction of the ground electrode 40 is thinner than the thickness length of the ground electrode 40 or a width length b2 (long side length) of a cross section of the intermediate member 60 perpendicular to the longitudinal direction of the ground electrode 40 is shorter than the width length of the ground electrode 40, that is, when a cross sectional area (S2=a2×b2) of the intermediate member 60 in parallel with the longitudinal direction of the ground electrode 60 is smaller than a cross sectional area of the ground electrode 40 perpendicular to the longitudinal direction thereof, the intermediate member 60 itself may be more easily bent to adjust the spark discharge gap 50 when the leading end of the ground electrode 40 on an opposite side to the fixed portion thereof is hammered in order for the leading end portion 43 of the ground electrode 40 to come near the leading end 31 of the center electrode 30.

Further, when the intermediate member 60 is made of Ni or Fe base alloy having a lower tensile strength than that of the ground electrode 60, the ground electrode 60 may be more easily bent for the spark discharge gap adjustment.

The cross sectional area S2 of the intermediate member 60 is preferably not smaller than 3.0 $mm^2$ and not larger than 8.0 $mm^2$. When the cross sectional area S2 is smaller than 3.0 $mm^2$, heat transfer through the intermediate member 60 gets worse so that temperature of the ground electrode 40 may be unusually increased. On the other hand, When the cross sectional area S2 is larger than 8.0 $mm^2$, an area where the intermediate member 20 is bonded to the end 12 of the housing 10 is too large to secure an adequate bonding strength.

A thickness L2 of the intermediate member 60 is preferably not shorter than 0.5 mm and not longer than 3.0 mm. When the thickness L2 is shorter than 0.5 mm, the intermediate member 60 itself is too short to be deformed by an aimed amount. When the thickness L2 is larger than 3.0 mm, the ground electrode 40 is protruded too deeply into the combustion chamber so that the heat resistance characteristic may be rapidly deteriorated.

For easily and reliably bonding the intermediate member 20 to the housing 10, it is also preferable that the length a2 of the short side of the rectangular cross section of the intermediate member 60 is not larger than 2.0 mm and a length b2 of the long side thereof is not larger than 4.0 mm. As the lower limit of the preferable range of the cross sectional area S2 is 3.0 $mm^2$, it is preferable that the short side length a2 is more than 0.75 mm and the long side length b2 is 1.5 mm. Further, material of the intermediate member 20 is preferably a Ni or Fe base alloy having a tensile strength of 350 to 1300 $N/mm^2$.

Figure 12:
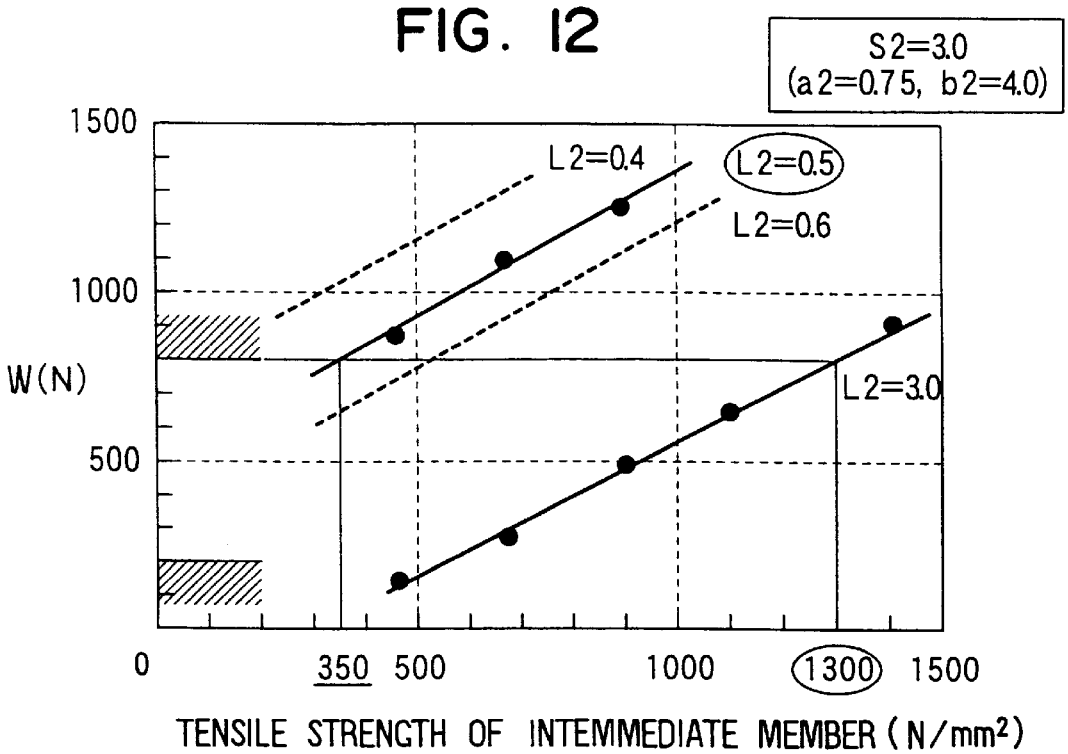
FIG. 12 is a graph showing a relationship between a tensile strength of intermediate member and a gap adjusting force W with respect to a thickness L2 of the intermediate member.

To decide the preferable range of the length L2 mentioned above, a test was conducted by the spark plugs having dimensions that the ground electrode 40 is most easily bent for the spark discharge adjustment, that is, when the cross sectional area S2 of the intermediate member 60 is 3.0 $mm^2$ (the thickness length a2 of the ground electrode is 0.75 mm and the width length b2 of the ground electrode is 4.0 mm), a lower limit of the preferable range. FIG. 12 shows the test result of a relationship between the gap adjusting force (N) and a tensile strength ($N/mm^2$) of material of the intermediate member 60 with respect to the various length L2 of the intermediate member 60. The preferable range of the gap adjustment force is 200 to 800 N in FIG. 12, too.

As shown in FIG. 12, as the length L2 is shorter or the tensile strength of electrode material is larger, the force W is larger, that is, the intermediate member 60 is more unlikely to be deformed to adjust the spark discharge gap. The test result shows that the length L2 of the intermediate member 60 is preferably not shorter than 0.5 mm in order for the intermediate member 60 made of Ni base alloy to be able to be bent by less than 800N gap adjustment force W, as the minimum tensile strength of Ni base alloy is 350 $N/mm^2$.

If the length L2 becomes longer than 0.5 mm, the intermediate member 60 made of Ni base alloy having a larger tensile strength can be bent. However, when the length L2 is 3.0 mm, an upper limit of the preferable range, the maximum tensile strength is preferably not larger than 1300 $N/mm^2$ so as to bend the intermediate members 60 with the less than 800 N gap adjustment force W.

As a summary of the preferable range of the dimensions of the intermediate member 60, the intermediate member 60 is made of the Ni or Fe base alloy is 350 to 1300 $N/mm^2$, the cross sectional area S2 of the intermediate member 60 is not smaller than 3.0 $mm^2$ and not larger than 8.0 $mm^2$, the thickness L2 of the intermediate member 60 is not shorter than 2.0 mm and not longer than 3.0 mm, the short side length a2 of the intermediate member 60 is not longer than 2.0 mm and the long side length b2 is not shorter than 4.0 mm.

Figures 13A, 13B, 13C:
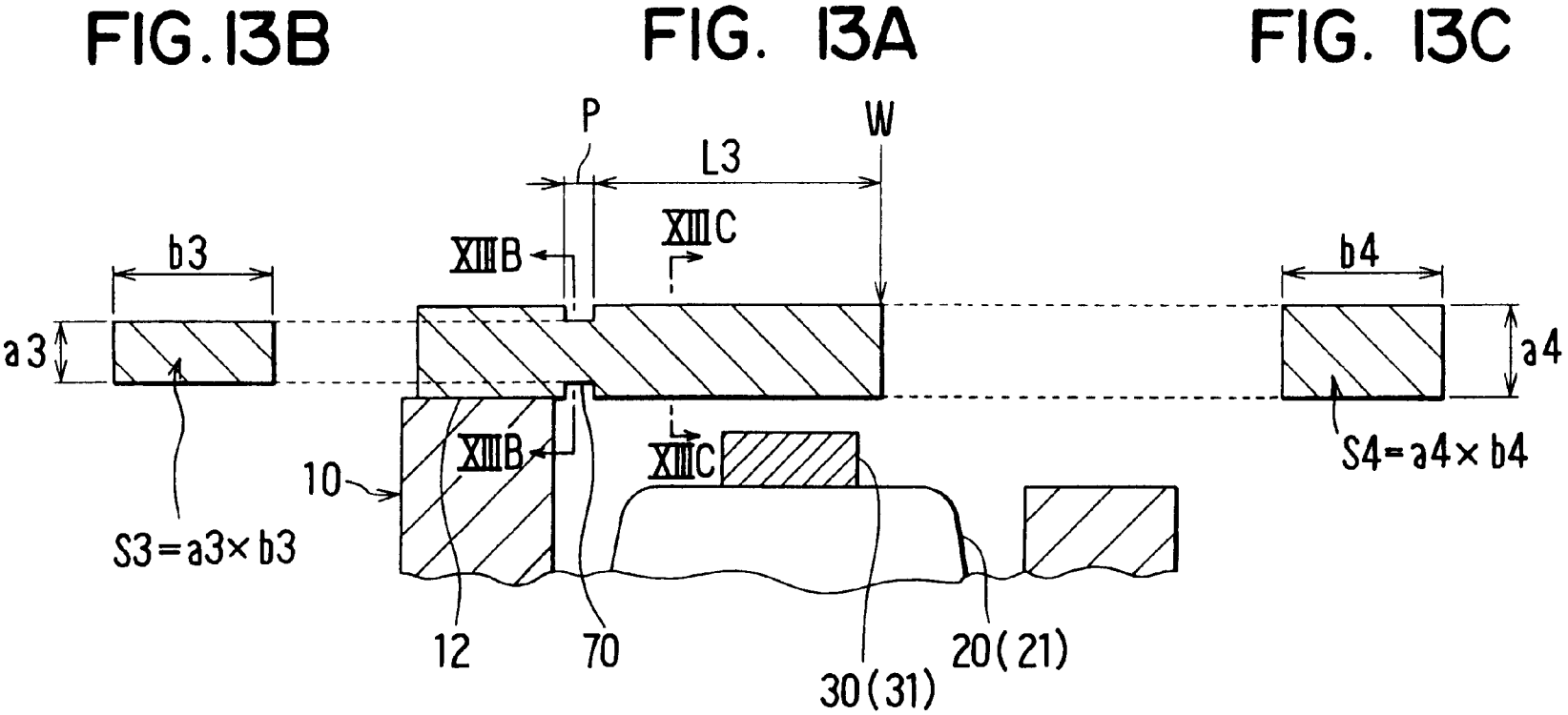
FIG. 13A is a cross sectional view of a spark plug
FIG. 13B is a cross sectional view taken along a line XIIIB—XIIIB of FIG. 13A.
FIG. 13C is a cross sectional view taken along a line XIIIC—XIIIC of FIG. 13A.

Furthermore, to easily adjust the spark discharge gap, a spark plug according to a fifth embodiment of the present invention is described with reference to in FIGS. 13A to 13C. FIG. 13B shows a cross section of the ground electrode 40 taken along a line XIIIB—XIIIB of FIG. 13A and FIG. 13C shows a cross section of the ground electrode 40 taken along a line XIIIC—XIIIC of FIG. 13A.

The spark plug shown in FIGS. 13A to 13C, which is a further modification of the spark plug shown in FIG. 5, is provided with a groove or cut 70 on the ground electrode in place of the chamfering 13. The groove or cut 70 is also applicable to and may be formed on the base element 41 of the ground electrode of the spark shown in FIG. 2A and 2B in place of the chamfering 13.

As shown in FIGS. 13A to 13C, the groove 70 passes through outside surfaces of the ground electrode 40 perpendicular to the longitudinal direction of the ground electrode 40. According to the fifth embodiment, the cross section of the ground electrode 40 perpendicular to the longitudinal direction thereof is shaped as a rectangular with a short side and a long side and the ground electrode is fixed to the end 12 of the housing at a side surface thereof including the long side of the rectangular. A cross sectional area s3 at the groove 70 is equal to a length of the short side a3 multiplied by a length of the long side b3 and a cross sectional area S4 at the other part of the ground electrode 40 is equal to a length of the short side a4 multiplied by a length of the long side b4.

The groove 70 according to the fifth embodiment is located near the fixed portion of the ground electrode 40 to the housing 10, to have a longer fulcrum for pushing the ground electrode 40 for the spark discharge gap adjustment. The cross sectional area S3 of the ground electrode 40 at the groove 70 is smaller than the cross sectional area S4 of the other part of the ground electrode 40. Therefore, the groove 70 serves to adjust the spark discharge gap with less force.

Though the groove 70 may be provided in parallel with an adjustment direction of the spark discharge gap so as to narrow a width of the ground electrode 40, it is more preferable that the groove 70 is provided perpendicular to the adjustment direction of the spark discharge gap, that is, thickness direction of the ground electrode 40, so as to make thinner a thickness of the ground electrode 40, as shown in FIGS. 13A to 13C.

The cross sectional area S3 of the ground electrode 40 shown in FIG. 13B is preferably not smaller than 2.0 $mm^2$. When the cross sectional area S3 is smaller than 2.0 $mm^2$, heat transfer through the ground electrode 40 at the grooved portion gets worse so that temperature of the ground electrode 40 may be unusually increased.

On the other hand, it is preferable that a length P of the groove 70 is not shorter than 0.5 mm and not longer than 2.0 mm. When the length P is shorter than 0.5 mm, an adequate bending of the ground electrode becomes difficult. When the length P is longer than 2.0 mm, an unfavorable restriction of heat transfer through the grooved portion becomes too large. Further, it is preferable that the groove 70 is away by more than 3.0 mm from the leading end of the ground electrode 40, that is, a length L3 from the leading end of the ground electrode 40 shown in FIG. 13A is by more than 3.0 mm.

Further, the long side length b3 at the groove 70 is preferably not longer than 4.0 mm due to the same reason described above with respect to the width length of the ground electrode 40. The short side length a3 at the groove 70 is preferably not shorter than 0.5 mm based on the preferable regions of the long side length b3 and the cross sectional area S3 at the groove 70.

Furthermore, material of the ground electrode 40 is preferably a Ni or Fe base alloy having a tensile strength of 350 to 1400 N/mm$^2$.

To decide the preferable range of the length P of the groove 70 mentioned above, a test was conducted by the spark plugs having dimensions that the ground electrode 40 is most easily bent for the spark discharge adjustment, that is, when the cross sectional area S3 at the groove 70 is 2.0 mm$^2$ (the short side length a3 is 0.5 mm and the long side length b3 is 4.0 mm), a lower limit of the preferable range and the length L3 is 6.0 mm, a upper limit from the practical standpoint.

Figure 14:
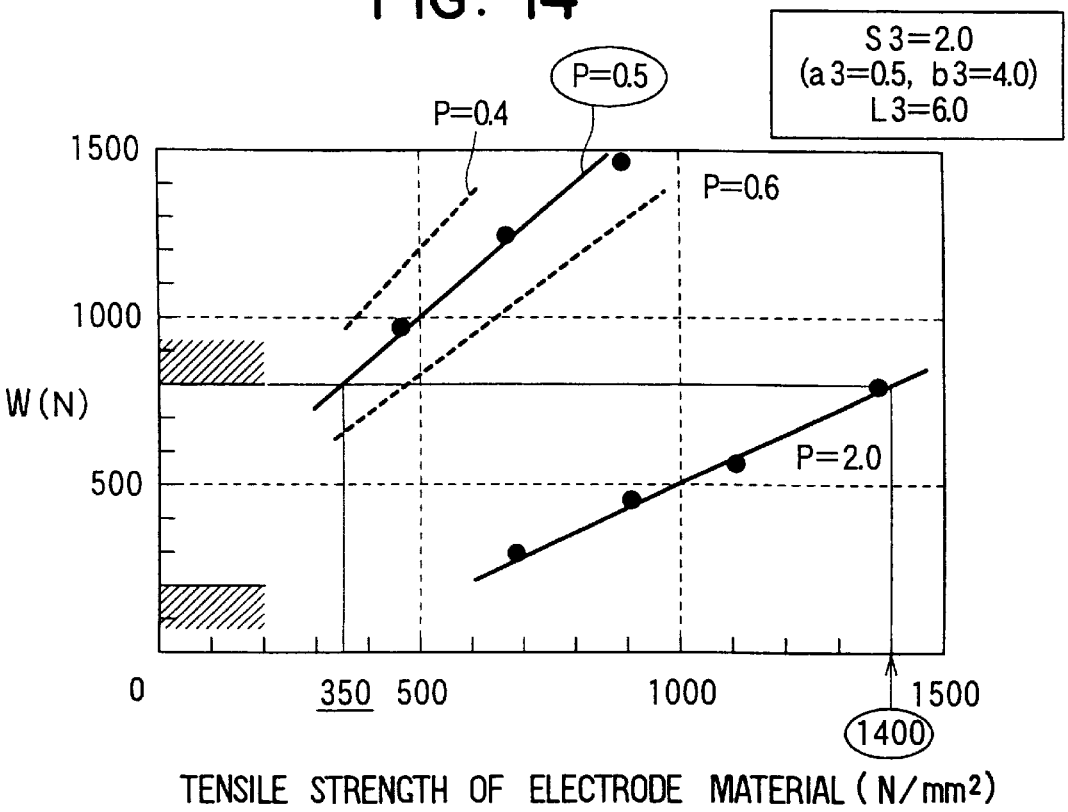
FIG. 14 is a graph showing a relationship between a tensile strength of electrode material and a gap adjusting force W with respect to a groove length p.

FIG. 14 shows the test result of a relationship between the gap adjusting force (N) and a tensile strength (N/mm$^2$) of material of the ground electrode 40 with respect to the various length P of the groove 70. The preferable range of the gap adjustment force is 200 to 800 N in FIG. 14, too.

As shown in FIG. 14, as the length P is shorter or the tensile strength of electrode material is larger, the force W is larger, that is, the ground electrode 40 is more unlikely to be deformed to adjust the spark discharge gap. The test result shows that the length P is preferably not shorter than 0.5 mm in order for the ground electrode 40 made of Ni base alloy to be able to be bent by less than 800N gap adjustment force W, as the minimum tensile strength of Ni base alloy is 350 N/mm$^2$.

If the length P becomes longer than 0.5 mm, the ground electrode 40 made of Ni base alloy having a larger tensile strength can be bent. However, when the length P is 2.0 mm, an upper limit of the preferable range, the maximum tensile strength is preferably not larger than 1400 N/mm$^2$ so as to bend the ground electrode 40 with the less than 800 N gap adjustment force W.

Further, To decide the preferable range of the length L3 of the groove 70 mentioned above, a test was conducted by the spark plugs having dimensions that the ground electrode 40 is most easily bent for the spark discharge adjustment, that is, when the cross sectional area S3 at the groove 70 is 2.0 mm$^2$ (the short side length a3 is 0.5 mm and the long side length b3 is 4.0 mm), a lower limit of the preferable range and the length P is 2.0 mm, a upper limit of the preferable range.

FIG. 14 shows the test result of a relationship between the gap adjusting force (N) and a tensile strength (N/mm$^2$) of material of the ground electrode 40 with respect to the various length L3 of the groove 70. The preferable range of the gap adjustment force is 200 to 800 N in FIG. 14, too.

Figure 15:
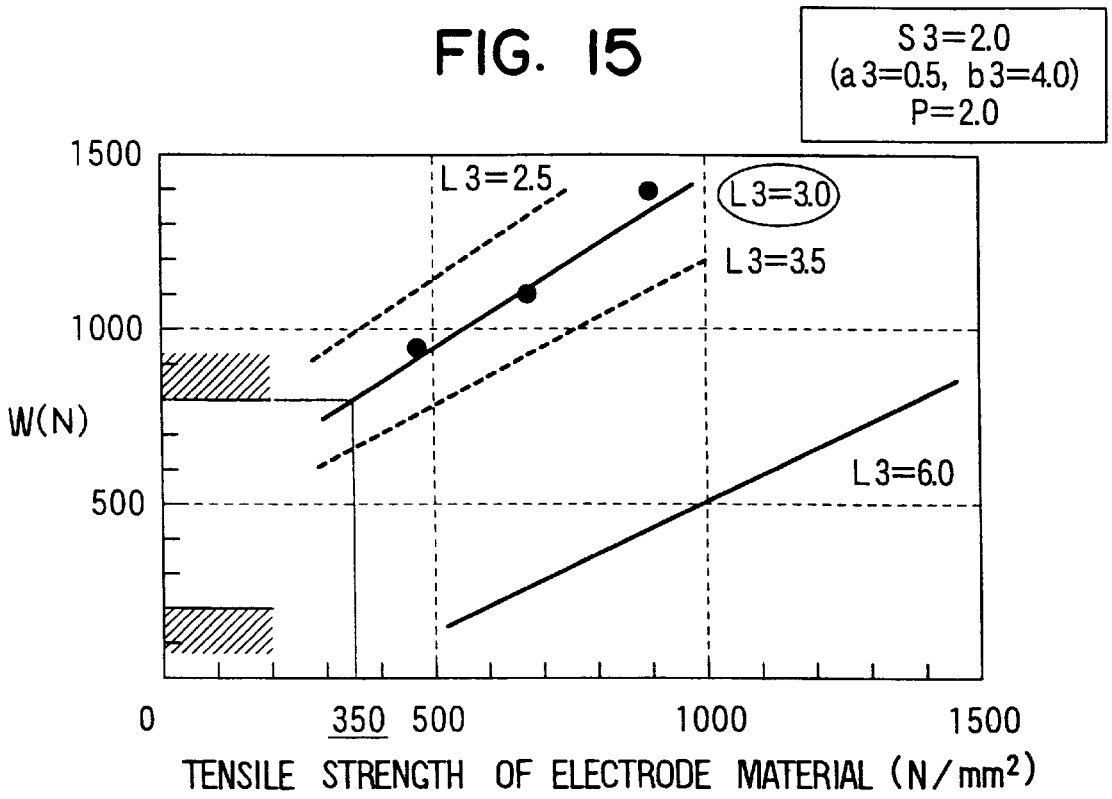
FIG. 15 is a graph showing a relationship between a tensile strength of electrode material and a gap adjusting force W with respect to a length L3 from an end of the ground electrode to the groove.
Figure 16:
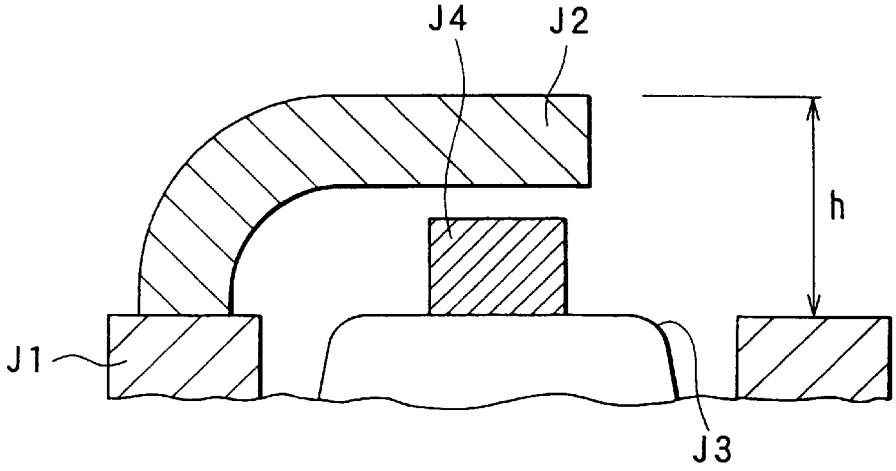
FIG. 16 PRIOR ART
FIG. 16 is a cross sectional view of conventional spark plug as a prior art.

As shown in FIG. 15, as the length L3 is shorter or the tensile strength of electrode material is larger, the force W is larger, that is, the ground electrode 40 is more unlikely to be deformed to adjust the spark discharge gap. The test result shows that the length L3 is preferably not shorter than 3.0 mm in order for the ground electrode 40 made of Ni base alloy to be able to be bent by less than 800N gap adjustment force W, as the minimum tensile strength of Ni base alloy is 350 N/mm$^2$.

As a summary of the preferable range of the dimensions of the groove 70, the ground electrode 40 is made of the Ni or Fe base alloy is 350 to 1400 N/mm$^2$, the cross sectional area S3 of the groove 70 is not smaller than 2.0 mm$^2$ but smaller than the cross sectional area S4 of the other part of the ground electrode 40, the length P of the groove is not shorter than 0.5 mm and not longer than 2.0 mm, the length L3 of the groove 70 is not shorter than 3.0 mm, the short side length a3 at the groove 70 is not longer than 0.5 mm but shorter than the short side length b4 at the other part of the ground electrode 40,and the long side length b3 is not longer than the long side length b4, that is not longer than 4.0 mm.

What is claimed is:

1. A spark plug comprising;

a center electrode;

a housing holding and being insulated with the center electrode, a leading end of the center electrode being exposed out of an end of the housing;

a ground electrode bonded at a first leading end thereof to the housing and extending straight from the housing substantially perpendicular to an axis of the housing so as to form a spark discharge gap between the leading end of the center electrode and a second leading end thereof; and means for easier adjustment of the spark discharge gap provided at least at any one of portions consisting of an inside edge of the end of the housing, a bridging portion between the end of the housing and the first leading end of the ground electrode, and an outside surface of the ground electrode, wherein the means for easier adjustment of the spark discharge gap is operative in such a manner that the second leading end of the ground electrode comes near the leading end of the center electrode with less force for adjusting the spark discharge gap.

2. A spark plug according to claim 1, wherein the ground electrode is composed of a base element made of any one of material of Ni base alloy and Fe base alloy and a noble metal alloy element, a first leading end of the base element being fixed to the leading end of the housing at a horizontal side of the leading end of the center electrode and a second leading end of the base element being bonded to a first leading end of the noble metal alloy element so as to extend the noble metal alloy element from the base element perpendicular to an axis of the housing so that a second leading end of the noble metal alloy element may face the leading end of the center electrode with the spark discharge gap therebetween.

3. A spark plug according to claim 1, further comprising;

a noble metal chip bonded and fixed to the second leading end of the ground electrode to constitute a spark discharge spot.

4. A spark plug according to claim 1, wherein the means for easier adjustment of the spark discharge gap is a relief provided at least at an inside edge of the leading end of the housing to which the first leading end of the ground electrode is fixed.

5. A spark plug according to claim 4, wherein a length C of the relief is not longer than 2.00 mm in a longitudinal direction of the ground electrode.

6. A spark plug according to claim 4, wherein the ground electrode is at least partly composed of an alloy having a tensile strength of 350 to 1200 N/mm$^2$, having a rectangular cross section perpendicular to a longitudinal direction thereof with a short side and a long side, where an area S1 of the rectangular cross section is not smaller than 3.0 mm$^2$ and not larger than 8.0 mm$^2$, a length a1 of the short side is not longer than 2.0 mm, a length b1 of the long side is not shorter than 1.2 mm and not longer than 4.0 mm and a length L1 extending from the end of the housing is not shorter than 2.0 mm and not longer than 6.0 mm.

7. A spark plug according to claim 6, wherein the ground electrode is fixed to the end of the housing at a side surface thereof including the long side of the rectangular cross section.

8. A spark plug according to claim 1, wherein the means for easier adjustment of the spark discharge gap is an intermediate member arranged between the leading edge of the housing and the first leading edge of the ground electrode, the intermediate member being made of material having a lower tensile strength than that of the ground electrode.

9. A spark plug according to claim 1, wherein the means for easier adjustment of the spark discharge gap is an intermediate member arranged between the leading edge of the housing and the first leading edge of the ground electrode, a cross sectional area S2 of the intermediate member in parallel with the longitudinal direction of the ground electrode being narrower than a cross sectional area of the ground electrode.

10. A spark plug according to claim 9, wherein the cross sectional area of the intermediate member is not smaller than 3.0 $mm^2$ and not larger than 8.0 $mm^2$.

11. A spark plug according to claim 9, wherein a thickness of the intermediate member perpendicular to a longitudinal direction of the ground electrode is not shorter than 0.5 mm and not longer than 3.0 mm.

12. A spark plug according to claim 9, wherein a cross section of the intermediate member is shaped as a rectangular with a short side a2 in parallel with the longitudinal direction of the ground electrode and a long side b2 perpendicular to the longitudinal direction of the ground electrode, where a length of the short side a2 is not larger than 2.0 mm and a length of the long side b2 is not larger than 4.0 mm.

13. A spark plug according to claim 8, wherein material of the intermediate member is any one of Ni base alloy and Fe base alloy having a tensile strength of 350 to 1300 $N/mm^2$.

14. As park plug according to claim 1, wherein the means for easier adjustment of the spark discharge gap is a groove provided on the outer surface of the ground electrode so as to be passed through perpendicular to the longitudinal direction of the ground electrode.

15. A spark plug according to claim 14, wherein the groove is provided perpendicular to an adjustment direction of the spark discharge gap so as to make the thickness of the ground electrode thinner at the grooved portion.

16. A spark plug according to claim 14, wherein a cross sectional area S3 of the ground electrode at the groove is not smaller than 2.0 $mm^2$.

17. A spark plug according to claim 14, wherein a length P of the groove is not shorter than 0.5 mm and not longer than 2.0 mm.

18. A spark plug according to claim 14, wherein the groove is away by more than 3.0 mm from the second leading end of the ground electrode.

19. A spark plug according to claim 14, wherein material of the ground electrode is any one of Ni base alloy and Fe base alloy having a tensile strength of 350 to 1400 $N/mm^2$.

* * * * *